US010480782B2

(12) United States Patent
Mintoft

(10) Patent No.: US 10,480,782 B2
(45) Date of Patent: Nov. 19, 2019

(54) FIRE CONSTRUCTIONS

(71) Applicant: Charlton & Jenrick Limited, Telford, Shropshire (GB)

(72) Inventor: Peter Mintoft, Telford (GB)

(73) Assignee: CHARLTON & JENRICK LIMITED, Telford (GB)

( * ) Notice: Subject to any disclaimer, the term of this patent is extended or adjusted under 35 U.S.C. 154(b) by 597 days.

(21) Appl. No.: 14/905,921

(22) PCT Filed: Jul. 10, 2014

(86) PCT No.: PCT/GB2014/052107

§ 371 (c)(1),
(2) Date: Jan. 18, 2016

(87) PCT Pub. No.: WO2015/008036

PCT Pub. Date: Jan. 22, 2015

(65) Prior Publication Data

US 2016/0186989 A1 Jun. 30, 2016

(30) Foreign Application Priority Data

Jul. 18, 2013 (GB) ..... 1312870.7
Oct. 25, 2013 (GB) ..... 1318922.0

(51) Int. Cl.
*F23B 60/02* (2006.01)
*F23L 9/04* (2006.01)
(Continued)

(52) U.S. Cl.
CPC ..... *F23B 60/02* (2013.01); *F23L 9/00* (2013.01); *F23L 9/04* (2013.01); *F24B 5/02* (2013.01); *F24B 5/021* (2013.01); *F24B 5/025* (2013.01)

(58) Field of Classification Search
CPC ..... F23L 9/02; F23L 9/04; F23G 5/14; F23G 2202/10; F23G 2202/101; F23G 2202/102;
(Continued)

(56) References Cited

U.S. PATENT DOCUMENTS 932,959 A 8/1909 Cahoone
4,265,213 A * 5/1981 Gorsuch ..... F24B 7/025 126/66
(Continued)

FOREIGN PATENT DOCUMENTS

BE 556914 A1 2/1960
CH 223503 A 9/1942
(Continued)

OTHER PUBLICATIONS

The International Search Report and Written Opinion issued in International Application No. PCT/GB2014/052107; dated Jan. 14, 2015.
(Continued)

*Primary Examiner* — David J Laux
(74) *Attorney, Agent, or Firm* — Pearne & Gordon LLP

(57) ABSTRACT

A fire construction (10) comprising a firebox (12) defining a combustion chamber (14) in which fuel (not shown) can be burnt, a first air supply means (16) for delivering air into the combustion chamber (14) to support combustion of fuel therein, and a second air supply means (18) for supplying additional air to support combustion of fuel within the combustion chamber (14), the second air supply means (18) comprising a supply conduit (20) connecting the combustion chamber (14) with an air supply (22), the supply conduit (20) having a cross section (24) that increases as the supply conduit (20) opens into the combustion chamber (14).

38 Claims, 8 Drawing Sheets

(51) Int. Cl.
*F24B 5/02* (2006.01)
*F23L 9/00* (2006.01)

(58) Field of Classification Search
CPC ..... F24B 5/025; F24B 1/18; F24B 1/1802; F24B 1/1804; F24B 1/181; F24B 1/185; F24B 5/023; F24B 5/026
See application file for complete search history.

(56) References Cited

U.S. PATENT DOCUMENTS

| | | | | |
|---|---|---|---|---|
| 4,483,312 | A | 11/1984 | Martenson | |
| 5,622,161 | A | 4/1997 | Stack | |
| 6,105,590 | A * | 8/2000 | Martin | F22B 37/48 134/166 R |
| 6,938,560 | B2 * | 9/2005 | Okazaki | F23C 6/045 110/204 |
| 7,047,891 | B2 * | 5/2006 | Vatsky | F23L 9/04 110/210 |
| 7,878,130 | B2 * | 2/2011 | Yamamoto | F23C 7/008 110/214 |
| 8,430,665 | B2 * | 4/2013 | Payne | F23C 6/047 110/203 |
| 2009/0084346 | A1 * | 4/2009 | Zhou | F23C 7/02 123/276 |
| 2012/0137938 | A1 * | 6/2012 | Orii | F22B 21/00 110/214 |

FOREIGN PATENT DOCUMENTS

| | | |
|---|---|---|
| FR | 1283804 A | 2/1962 |
| FR | 2900461 | 11/2007 |
| GB | 2274162 | 7/1994 |
| GB | 2436869 | 10/2007 |

OTHER PUBLICATIONS

The Combined Search and Examination Report under Section 17 & 18(3) issued in corresponding Great Britain Application No. GB1318922.0; dated Nov. 15, 2013.

The examination report issued in the corresponding European Patent Application No. 14739535.4; dated Feb. 16, 2018.

* cited by examiner

FIRE CONSTRUCTIONS

The present invention relates to fire constructions, and more particularly to fire constructions or stoves used to burn solid fuel such as coal, wood, biomass fuels and the like.

The combustion of solid fuels within the enclosed combustion chambers or fireboxes of known solid fuel fires or stoves is generally considered to be reasonably effective in terms of the generation of heat, but often the amounts of pollutants that can be exhausted, such as carbon monoxide and particulates, can be unsatisfactory.

Air is of course required to support combustion within an enclosed combustion chamber, and conventionally fire constructions, particularly those designed for burning coals, provide for a primary air supply to support the primary combustion of the fuel. This is typically provided from a position beneath the fuel and is generally referred to as primary air.

Primary air alone however is often considered insufficient to achieve satisfactory levels of combustion of certain fuels such as coals, and so fire constructions designed to burn such fuels typically have a secondary air supply provided at a position above the fuel to provide some secondary support for combustion. Such secondary air is used in certain known fire constructions to provide an air wash over the inside of a glass door of the construction, to help keep the glass door relatively clear of soot and other visible by-products of the combustion process.

In certain fire constructions such as those designed to burn wood, such secondary air provides the main air supply supporting combustion, in which case an aforesaid primary air supply is not provided.

In certain known fire constructions a further, often termed tertiary air supply is provided to present tertiary air to further support the combustion process. In fire constructions that have both primary and secondary air supplies, the tertiary air supply offers a third air supply to the combustion process, as its name suggests. In fire constructions that have no primary air supply and just a secondary air supply, the tertiary air supply represents a second air supply to the combustion process. However, it is still often referred to as tertiary air.

In both such constructions, the tertiary air's main function is to support combustion of particulate and other by-products of the main combustion processes within the fire construction.

In accordance with aspects of the present invention there is provided a fire construction comprising a firebox defining a combustion chamber in which fuel can be burnt, a first air supply means for delivering air into the combustion chamber to support combustion of fuel therein, and a second air supply means for supplying additional air to further support combustion of fuel within the combustion chamber, the second air supply means comprising a supply conduit connecting the combustion chamber with an air supply, the supply conduit having a cross section that increases as the supply conduit opens into the combustion chamber.

The second air supply means may comprise a plurality of supply conduits. The supply conduit or at least one of the supply conduits may extend through a wall of the firebox. The supply conduit or at least one of the supply conduits may be formed as (a) passage(s) within the wall. Alternatively or in addition the supply conduit(s) may comprise a body defining (a) passage(s) located through the wall.

The supply conduits may be aligned, in a generally linear arrangement, which may extend generally horizontally in use. The supply conduit or at least one of the supply conduits may be located in a rear wall of the firebox, which rear wall defines at least in part an inner rear surface of the firebox. Alternatively or in addition the supply conduit or at least one of the supply conduits may be located in one or more of the side walls of the firebox, which side wall(s) define (an) inner side surface(s) of the firebox.

The supply conduit or at least one of the supply conduits may open into the combustion chamber at a location above fuel in the fire and may be located in an upper region of the rear wall and/or side wall(s), which may be at or near the top of the inner rear surface and/or inner side surface(s) of the firebox. The arrangement of supply conduits may extend across the inner rear surface and/or inner side surface(s) at a location at or near the top thereof.

The cross section of the supply conduit or at least one of the supply conduits increases in the direction the additional air generally flows through the supply conduit into the combustion chamber. The cross section may increase in the general direction of and may be along the longitudinal axis of the supply conduit(s).

The cross section may flare outwardly as a conduit opens into the combustion chamber to have a flared region.

The flared region may extend from partway along the length of the conduit to the combustion chamber. The supply conduit may comprise a region of generally constant cross section, such as in the form of a circular passage or tubular section from which extends the flared region.

The flared region may be generally frustoconical.

The flared region may have an inner surface which is stepped, to provide at least one stepped increase in cross section.

The inner surface may comprise a sequence of stepped sections in which the section(s) may extend at an angle of between 0° and 90° to the directional axis of the conduit through the rear wall.

The angle may differ between respective step sections. At least one step section may extend at an angle of substantially 90° to the said directional axis, other, possibly adjacent step sections may extend at an angle of between 30° and 60° and may be approximately 45° to said directional axis.

The supply conduit or at least one of the supply conduits may open into the combustion chamber on the inner rear surface. Alternatively or in addition the supply conduit or at least one of the supply conduits may open into the combustion chamber on one or more of the inner side surfaces.

Alternatively or in addition, the or at least one of the supply conduits may extend through to protrude from the inner rear surface to extend into the combustion chamber.

Alternatively or in addition the or at least one of the supply conduits may extend through to protrude from the or at least one of the inner side surfaces to extend into the combustion chamber.

Supply conduit(s) that open on the inner rear surface and/or inner side surface(s) may open in a recessed region of the inner rear surface and/or inner side surface(s). The recessed region may comprise an in-use upper, generally straight edge, and may further comprise an in-use lower, generally profiled edge that follows the profile(s) of the supply conduit(s) as they open onto the surface, in generally spaced relation thereto to define the recess on the surface, around the supply conduit(s).

The supply conduit or at least one of the supply conduits may have a generally circular cross section around the directional axis thereof as they extend through the firebox.

Alternatively or in addition, the, one or at least some of the supply conduit(s) may have an elongate cross section across the direction of extension thereof through the firebox. Such conduit(s) with elongate cross section may define a slot or similar elongate opening that opens into the combustion chamber. Such supply conduits may share a flared region.

The supply conduit(s) may connect the combustion chamber to an air supply, which may be ambient, atmospheric air, externally of the firebox. The air supply may also supply air for the first air supply means.

The firebox may comprise a base, a top, two side walls, a front and a rear wall, which between them define the combustion chamber.

Aspects of the present invention will now be described by way of example only with reference to the accompanying drawings in which.

Figure 1:
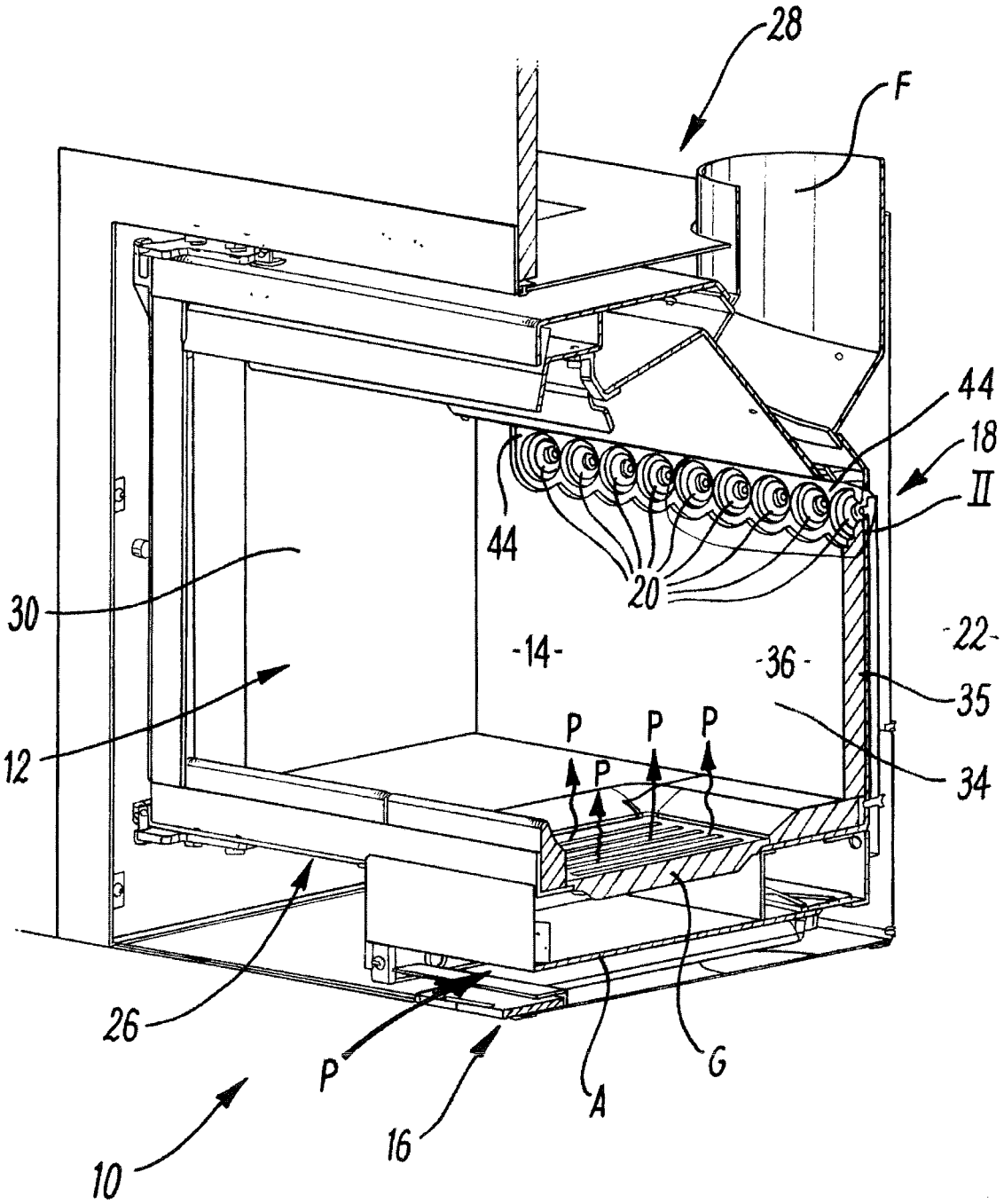
FIG. 1 is a diagrammatic perspective cut away section of a fire construction in accordance with aspects of the present invention.
Figure 2:
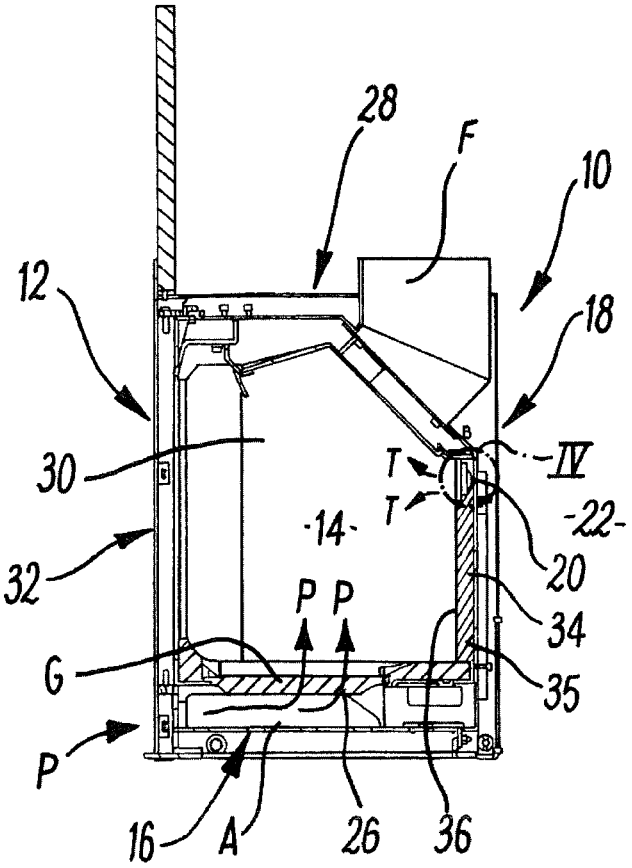
FIG. 2 is a diagrammatic cross section of the fire of FIG. 1.

The present invention provides a fire construction 10 comprising a firebox 12 defining a combustion chamber 14 in which fuel (not shown) can be burnt, a first air supply means 16 for delivering air into the combustion chamber 14 to support combustion of fuel therein, and a second air supply means 18 for supplying additional air to support combustion of fuel within the combustion chamber 14, the second air supply means 18 comprising a supply conduit 20 connecting the combustion chamber 14 with an air supply 22, the supply conduit 20 having a cross section 24 that increases as the supply conduit 20 opens into the combustion chamber 14.

In more detail, FIG. 1 illustrates diagrammatically a cross sectional, part perspective view from one side of a fire construction 10 in accordance with aspects of the present invention. The fire construction 10 comprises a firebox 12 that has a base 26, a top 28, two side walls (one of which is shown at 30), a front 32 and a rear 34, which between them generally define the combustion chamber 14.

The general construction of the firebox 13 is that of conventional fireboxes and comprises a grate G or other support for the fuel (not shown) and an ash box A beneath the grate to collect ash that falls through the grate from combustion.

A flue or chimney F is provided through which the gaseous and other products of combustion are exhausted.

The first air supply means 16 is what is conventionally termed in the art a primary air supply and is of conventional design, and will not be discussed in particular detail in this specification. However, essentially it supplies primary air, typically from externally of the fire construction, and usually through openings in the base or the front of the firebox into the combustion chamber 12. Primary air is typically drawn into the firebox through the primary air supply means 16 and into the combustion chamber 14 generally from beneath, up and through the fuel. Convections caused by combustion draw the primary air into the firebox 12. A typical primary air flow is illustrated diagrammatically with the arrows P.

In certain embodiments a secondary air supply means (not shown) is provided, which again is of conventional design and will not be discussed in particular detail herein. Such secondary air supply can provide air into the combustion chamber, usually at the front of the combustion chamber, to further support combustion and/or provide an air wash, typically over the inside of the front 32. Such secondary air supply is distinct from the second air supply of the present invention.

In such embodiments the second air supply means of the present invention provides additional air which may typically be understood in the art as tertiary air.

In certain other embodiments such a secondary air supply means may provide the main air supply for combustion within the construction. This can be so in fire constructions designed to burn fuels such as wood or wood-derived fuels, and in such constructions this secondary air supply represents the first air supply means within the present invention.

The top 28 and the sides 30 may be of generally conventional construction, typically comprising the main structural walls of the firebox, often of cast iron or other suitable material. Fire brick 35 or other insulating materials typically lines at least the sides 30 and rear 34.

The front 32 is again of generally conventional design, typically comprising a door that can be selectively opened and closed for access into the combustion chamber, such as for the placement of fuel for combustion.

The front 32 is illustrated as having a transparent viewing panel, which is typically of fire glass, and in those embodiments that have a secondary air supply directed to provide an air wash over the inside surface of the glass, this helps to prevent visible by-products such as soot from resting on the glass.

The second air supply means 18 of the present invention provides for improved combustion and provides a general reduction in overall pollutants expelled from conventional fire constructions, as will now be described.

With reference to FIGS. 1 to 4, the second air supply means 18 comprises an elongate arrangement or series of supply conduits 20 which extends across an inner rear surface 36 of the rear 34 at a location at or near the top of that surface 36. This location is considered to help in improving combustion.

Figure 4:
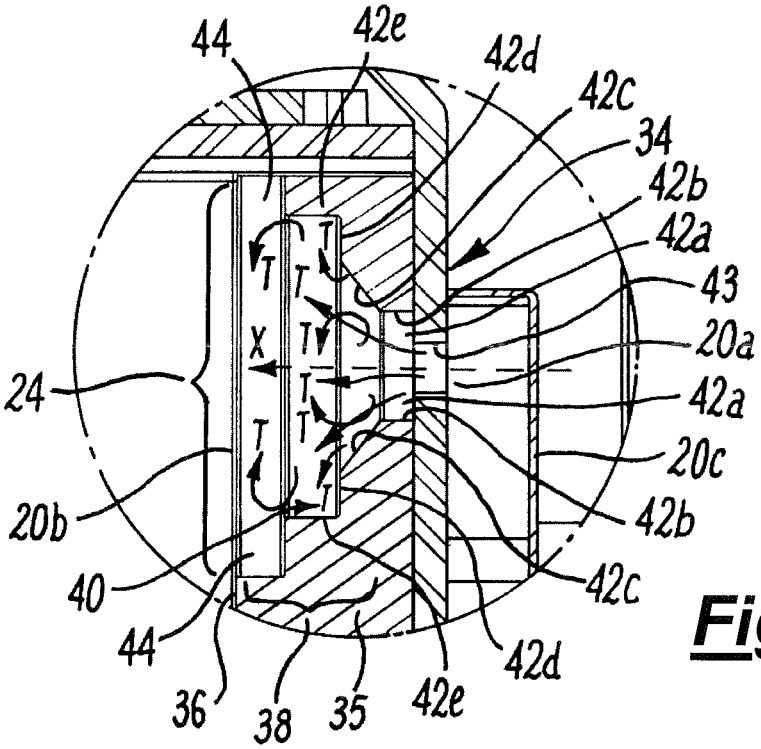
FIG. 4 is a diagrammatic cross section along a supply conduit and enlarged detail view of IV of FIG. 2 in accordance with aspects of the present invention.
Figure 3:
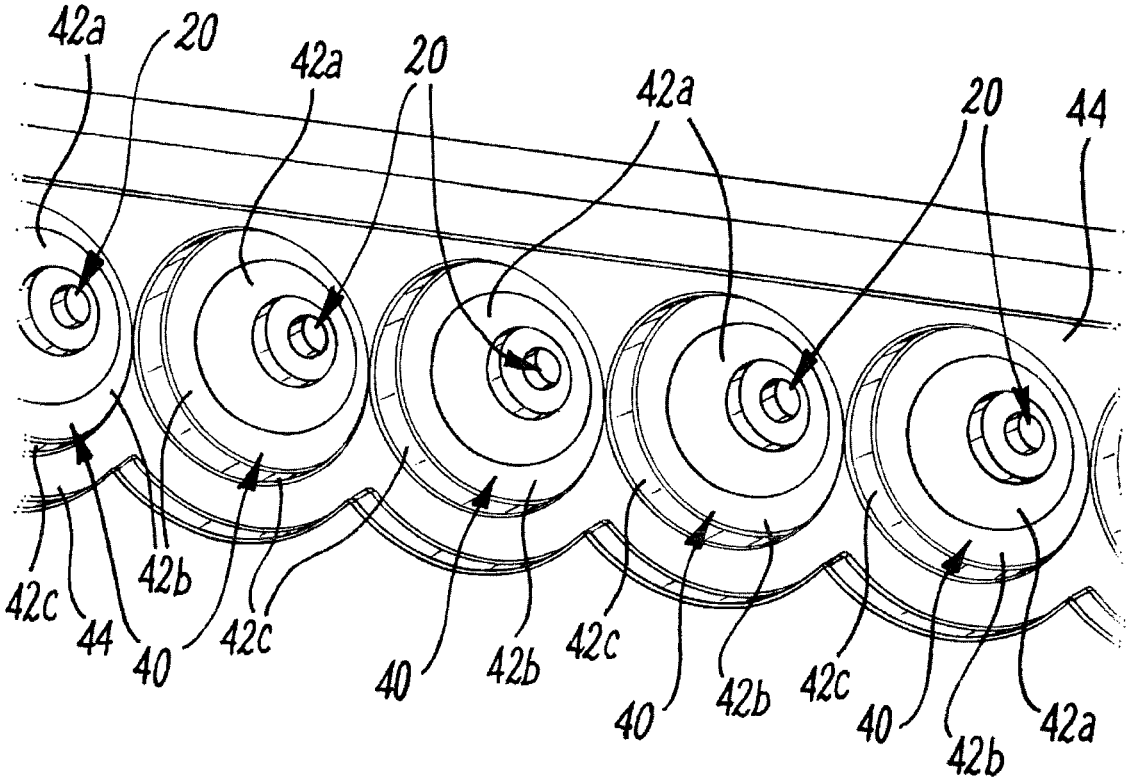
FIG. 3 is a diagrammatic illustration of a series of second air supply conduits as shown generally in the region II in FIG. 1, in enlarged detail.

With particular reference to FIG. 4, each supply conduit 20 extends through the rear 34 of the firebox to open into the combustion chamber 14 on the inner rear surface 36. As illustrated, each conduit 20 is formed in the rear 34 to define a passage therethrough. In constructions where fire brick 35 is provided the conduits 20 are typically formed at least in part in the fire brick 35. In alternative embodiments the or at least one of the conduits 20 may comprise a body such as a tubular body (not shown) that extends through (a) corresponding passage(s) formed in the rear 34. Such embodiments are described in more detail with reference to FIG. 8.

The cross section of each supply conduit 20 increases in the direction the additional air generally flows through the conduit 20 into the combustion chamber 14. In this embodiment, the cross section flares outward as each conduit 20 opens into the combustion chamber 14, giving each such conduit 20 a flared region 38 at the end thereof that opens into the combustion chamber 14.

The flared region 38 of a supply conduit 20 has an inner surface 40 which is stepped, to provide stepped increases in cross section.

As can be seen in FIG. 4, the region 38 comprises a sequence of stepped sections 42*a, b, c, d* and *e* which between them define the stepped inner surface 40.

Section 42*a* extends generally perpendicularly from an inner section 43 formed through the rear wall 34 and of generally constant cross section to section 42*b* which extends generally perpendicularly therefrom and generally parallel to the directional axis X of the conduit 20 to in turn meet section 42*c* which extends outward therefrom at a constant angle from the directional axis X to define a generally frustoconical section of the conduit 20. The angle illustrated is generally 45°. The adjacent section 42*d* extends outwardly from the section 42*c* in a direction generally perpendicular to the axis X and section 42*e* extends from section 42*d* to be generally perpendicular to the section 42*d* and parallel to section 42*b* of the axis X. The sections 42*a* and 42*b* define a generally tubular region of the conduit 20 of constant cross section which is connected to another generally tubular region defined by section 42*d* and 42*e* by the generally frustoconical region defined by the section 42*c*. These regions are all defined within the fire brick 35.

Each conduit 20 opens about the section 42*e*, in a recessed region 44 of the rear surface 36. The recessed region 44 provides an effective extension of the conduits 20, both in their effective length and cross sectional area.

Each supply conduit 20 extends from an outer end 20*a* which communicates with the air supply which is illustrated generally as 22 in FIG. 1, through the rear of the firebox 12 to open into the combustion chamber 14 at its opposite end 20*b*.

The air supply 22 is ambient or atmospheric air which is typically sourced from externally of the fire construction 10, from the space such as the room in which the construction 10 is sited. Additional conduit sections 20*c* may extend from the rear wall 34 to communicate with the air supply 22.

In use, the second air supply means 18 provides a flow of additional air from the air supply 22, through the conduits 20 and into the combustion chamber 14 where the conduits 20 open into the combustion chamber 14.

Arrows T illustrate diagrammatically the main flow of additional air through the conduit(s) 20. General convections within the combustion chamber draw the air through the conduits 20.

As will now be discussed, the profile of the cross section of a conduit 20 will determine the typical air flow therethrough. For example, profiles that define corners or ridges, such as those discussed above, will influence the flow T by causing swirls or eddies within the air flow. The profile can therefore be engineered to provide such desired turbulence.

The increase in cross section of a supply conduit 20 as it opens into the combustion chamber 14 is found to provide efficient combustion, typically final stage combustion, particularly of particulates and other pollutants rising up the rear of the firebox 12 as by-products of the primary or main combustion process within the chamber 14.

Without wishing to be bound by theory, the increase in the cross sectional area of a supply conduit 20 is understood to result in a reduction in the speed of the air flow as it enters and moves through the region where the cross sectional area increases (diameter widens). This reduction in speed is concomitant with an increase in pressure.

These effects are understood to provide for entrainment of partly combusted particulates rising up the rear of the firebox, as by-products of primary combustion, into the additional air flow, which has been found to increase the amount and efficiency of this secondary or tertiary combustion, thus reducing the percentage of particulates eventually exhausting from the fire construction 10.

It is also found that the second air supply means 18 of the present invention enables a satisfactory level of secondary or tertiary combustion to be achieved with a reduced amount of additional air, which improves thermal efficiency by allowing less external air into the combustion process.

Increasing the cross sectional area of a conduit 20 in a series of discrete steps, as illustrated, is understood to result in turbulence as the air flows therethrough as the air experiences the corners and recesses presented by the steps, which turbulence helps to mix the additional air with the fuel gases and particulates produced by the primary combustion to further support combustion.

The reduction in air speed and the increase in pressure within the flared region 38 continues into the recessed region 34, helping to retain the by-products of combustion in the vicinity of the incoming air, resulting in a longer dwell time and promoting better mixing of particulates, gases and air, prolonging the combustion process and thus presenting better secondary or tertiary combustion and reduction of particulates and other pollutants.

It has also been found that establishing these differential air pressures/velocities also helps to reduce the carbon monoxide levels that are exhausted from the fire construction.

Figure 5:
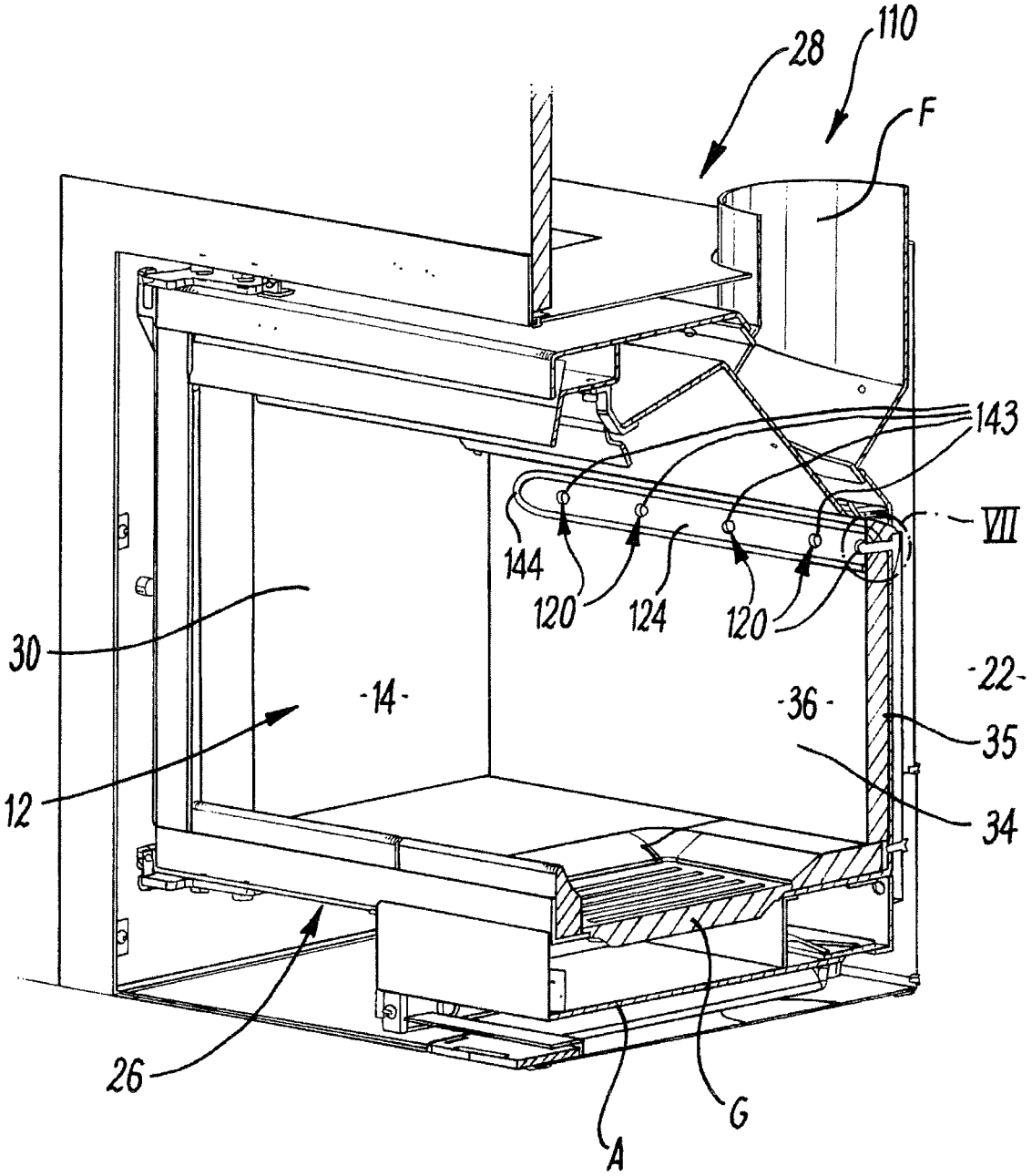
FIG. 5 is a diagrammatic perspective cut away section of a fire construction in accordance with further aspects of the present invention.

FIG. 5 is a diagrammatic perspective cut away section of a fire construction 110 in accordance with further aspects of the present invention.

The fire construction 110 is generally of similar construction to the aforedescribed fire construction 10 and corresponding features are identified with corresponding reference numerals.

In this embodiment the conduits 120 open onto the rear inner surface 36 through a shared elongated flared cross section 124.

Each supply conduit 120 comprises one of a linear series of inner sections 143 which extend through the rear 34 of the fire construction 110 in generally similar manner to the sections 43 described above.

Figure 7:
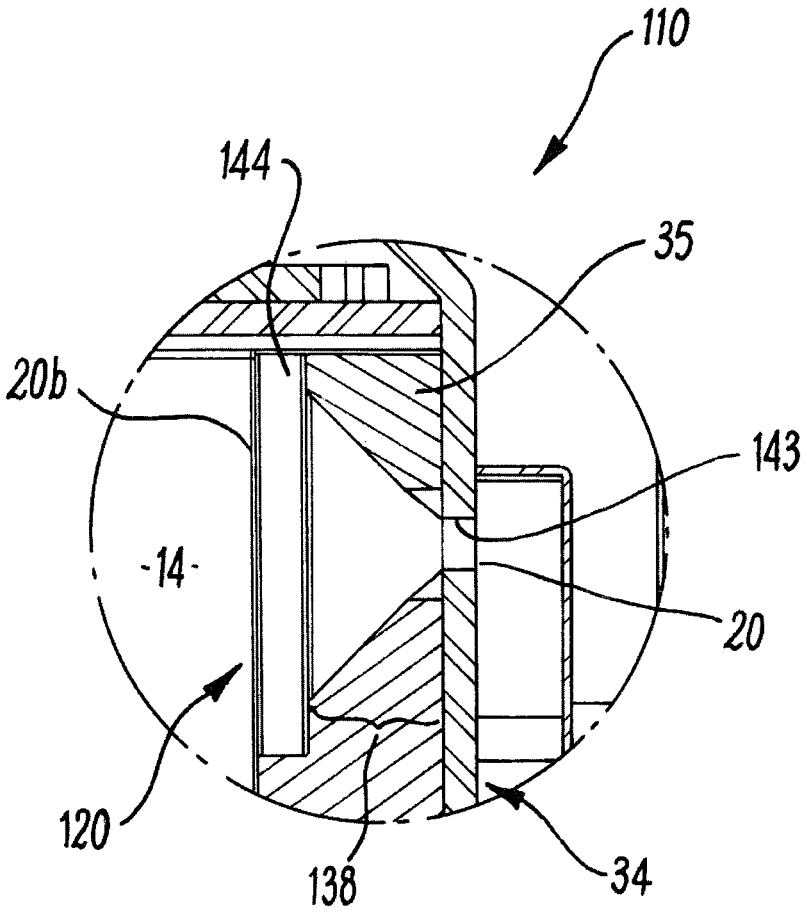
FIG. 7 is an enlarged cross sectional detail similar to that of FIG. 4 of a supply conduit according to still further aspects of the present invention.

As can be seen in FIG. 7, each conduit 120 flares out to communicate with the combustion chamber 14 to have a flared region 138 which is elongated and extends across and communicates with each of the sections 143. The flared region 138 opens into a recessed region 144 which acts to further support combustion in similar manner to the recessed regions 44 discussed above. This slot-like, enlarged cross section, shared between the conduits 120, again provides for improved combustion as discussed above, in a relatively simple construction.

Figure 6:
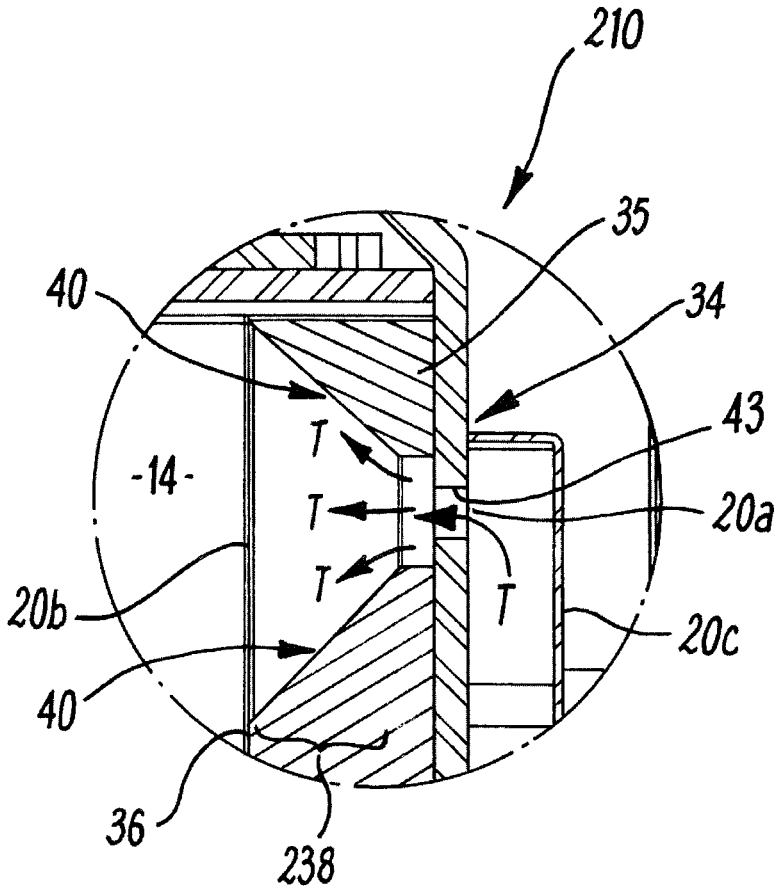
FIG. 6 is an enlarged cross sectional detail similar to that of FIG. 4, of a supply conduit according to further aspects of the present invention.

FIG. 6 is an enlarged cross sectional detail of a supply conduit 210 according to further aspects of the present invention. The conduit 210 is part of a series of conduits, generally as described above in relation to FIGS. 1 to 4, but the flared region 238 defines a single generally frustoconical region 238 that opens directly onto the inner rear surface 36. The region 238 extends from a generally constant cross sectional region 238, defined by sections 242*a*, 242*b*, which connect the region 238 to a section 243. Such conduits 120 provide a more simple construction than that illustrated in FIGS. 1 to 4 which has been found to still offer improved combustion.

Figure 8:
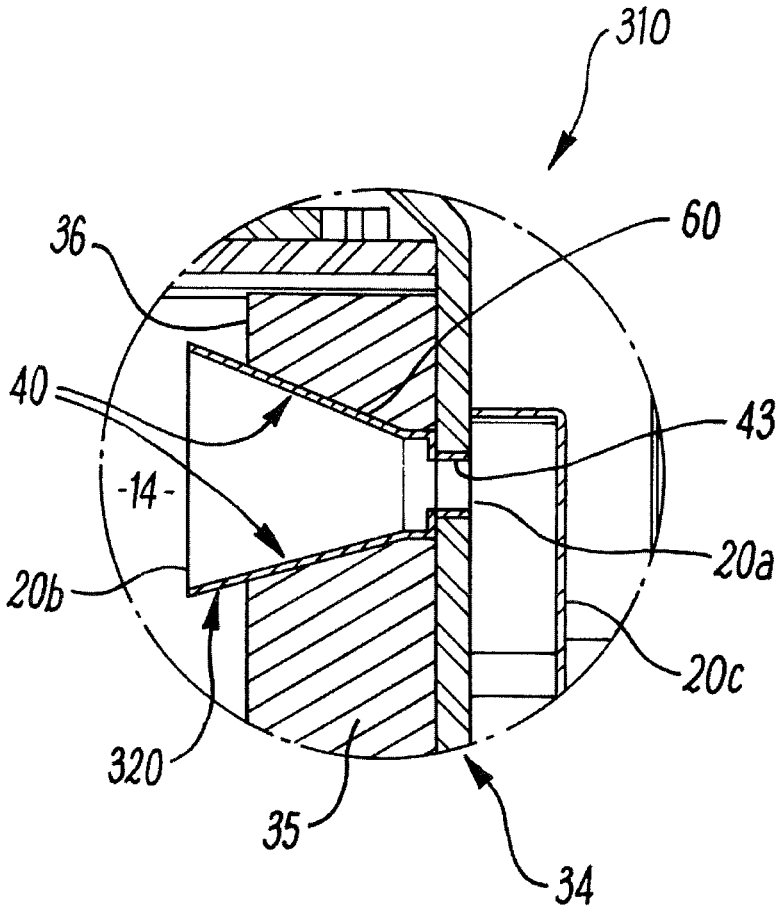
FIG. 8 is an enlarged cross sectional detail similar to that of FIG. 4 of a supply conduit according to still further aspects of the present invention.

FIG. 8 is an enlarged cross sectional detail of a supply conduit 310 according to still further aspects of the present invention. The conduit 310 is formed of a tubular body 60 located in a correspondingly shaped passage formed through the rear 34 of the fire construction 310. The body 60 may be formed of any suitable material, such as metal.

Providing the conduit 310 formed as a separate body to the rear 34 enables the body 60 to protrude from the inner rear surface 36 into the combustion chamber 14 to enable the additional air to be expelled into the combustion chamber 14 at a location that is forward of the rear surface 36.

This can provide for precise location of the point of entry of the additional air to be engineered to still further help enhance combustion and reduce pollutants in particular fire constructions.

Figure 9:
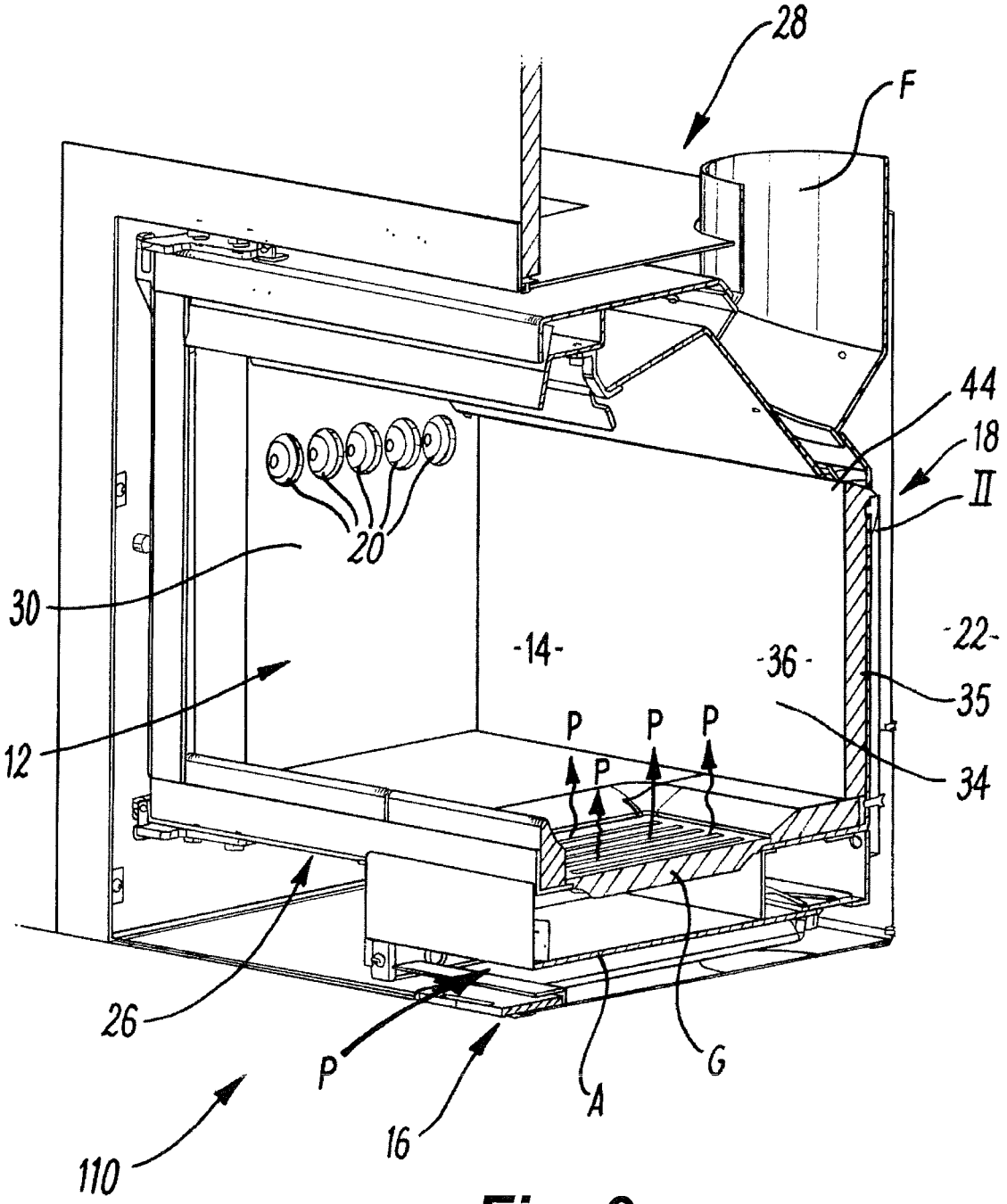
FIG. 9 is a diagrammatic perspective cut away section of a fire construction according to further aspects of the present invention.

FIG. 9 illustrates diagrammatically a cross sectional, part perspective view from one side of a fire construction 110 in accordance with further aspects of the present invention.

The fire construction 110 is similar to the fire construction 10 detailed above, and shared features are marked with the same reference numerals. However, in this construction 110, the supply conduits 20 extend through the side wall 30, rather than the rear 34. Each of the supply conduits 20 in this embodiment are the same as those detailed above with reference to the construction 10, although the number and/or size of the supply conduits 20 may be reduced compared to those provided in construction 10 due to the side walls typically being smaller in width (front to back) than the rear 34 (side to side).

For illustration purposes only one side wall 30 is shown, but it will be appreciated that supply conduits can be provided in the side wall 30 and the opposing side wall (not illustrated) so that air is supplied into the combustion chamber 14 from both sides.

It will be still further appreciated that in accordance with certain aspects of the present invention one or more supply conduits can be provided in both the rear 34 and one or both of the side walls 30.

Features described in the preceding description may be used in combinations other than the combinations explicitly described. Although functions have been described with reference to certain features, those functions may be performable by other features, whether described or not. Although features have been described with reference to certain embodiments, those features may also be present in other embodiments, whether described or not.

Various modifications may be made without departing from the spirit or scope of the present invention.

For example, the number and relative positioning of the supply conduits can be varied and engineered according to the desired characteristics of the additional air entry positions. The profile and design of the inner surface of the increased cross section of each conduit can be designed and engineered to provide the desired flow characteristics of the additional air flow.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A fire construction comprising a firebox defining a combustion chamber in which a fuel can be burnt, a front opening for access to the combustion chamber for the placement of said fuel configured to be closable by a door, a first air supply means for delivering air into the combustion chamber to support combustion of the fuel therein, and a second air supply means for supplying additional air to further support combustion of particulates and other pollutants rising up within the combustion chamber as by-products of primary combustion, the second air supply means comprising a supply conduit connecting the combustion chamber with an air supply, the supply conduit having a cross section that increases as the supply conduit opens into the combustion chamber to have a generally frustoconical flared region at a location above the fuel in the firebox, wherein the fire construction is a residential fireplace.

2. A fire construction according to claim 1, in which the second air supply means comprises a plurality of supply conduits.

3. A fire construction according to claim 2, in which the plurality of supply conduits are aligned in a generally linear arrangement.

4. A fire construction according to claim 3, in which the plurality of supply conduits extend in a generally horizontal arrangement.

5. A fire construction according to claim 2, in which at least one of the supply conduits opens into the combustion chamber at a location above the fuel in the firebox.

6. A fire construction according to claim 2, in which the plurality of supply conduits extends across an inner rear surface and/or an inner side surface at a location at or near the top of the inner rear surface and/or the inner side surface.

7. A fire construction according to claim 2, in which at least one supply conduit is located in each of two opposing side walls of the firebox.

8. A fire construction according to claim 1, in which the supply conduit extends through a wall of the firebox.

9. A fire construction according to claim 1, in which the supply conduit is formed as a passage within a wall of the firebox.

10. A fire construction according to claim 1, in which the supply conduit comprises a body defining a passage located through a wall of the firebox.

11. A fire construction according claim 1, in which the supply conduit is located in a rear wall of the firebox that defines at least in part an inner rear surface of the firebox.

12. A fire construction according to claim 11, in which the supply conduit opens into the combustion chamber on the inner rear surface.

13. A fire construction according to claim 12, in which the supply conduit opens in a recessed region of the inner rear surface.

14. A fire construction according to claim 13, in which the recessed region comprises an upper, generally straight edge.

15. A fire construction according to claim 13, in which the recessed region comprises a lower, generally profiled edge that follows the profile of the supply conduit as the supply conduit opens onto the inner rear surface, in generally spaced relation thereto to define the recess around the supply conduit.

16. A fire construction according to claim 11, in which the supply conduit extends through to protrude from the inner rear surface to extend into the combustion chamber.

17. A fire construction according to 1, in which the supply conduit is located in a side wall of the firebox that defines at least in part an inner side surface of the firebox.

18. A fire construction according to claim 17, in which the supply conduit opens into the combustion chamber on the inner side surface.

19. A fire construction according to claim 17, in which the supply conduit extends through to protrude from the inner side surface to extend into the combustion chamber.

20. A fire construction according to claim 1, in which the supply conduit is located in an upper region of a rear wall and/or a side wall.

21. A fire construction according to claim 20, in which the upper region is at or near the top of the rear wall and/or the side wall.

22. A fire construction according to claim 1, in which the cross section of the supply conduit increases in the general direction of a longitudinal axis of the supply conduit.

23. A fire construction according to claim 1, in which the generally frustoconical flared region extends from partway along the length of the supply conduit to the combustion chamber.

24. A fire construction according to claim 1, in which the supply conduit comprises a region of generally constant cross section from which extends the generally frustoconical flared region.

25. A fire construction according to claim 1, in which the generally frustoconical flared region has an inner surface that is stepped, to provide at least one stepped increase in cross section.

26. A fire construction according to claim 25, in which the inner surface comprises a sequence of stepped sections.

27. A fire construction according to claim 26, in which the sections extend at an angle of between 0° and 90° to a directional axis of the supply conduit.

28. A fire construction according to claim 27, in which the angle differs between respective step sections.

29. A fire construction according to claim 26, in which at least one step section extends at an angle of substantially 90° to a directional axis of the supply conduit.

30. A fire construction according to claim 29, in which other step sections extend at an angle of between 30° and 60° to the directional axis of the supply conduit.

31. A fire construction according to claim 30, in which other step sections extend at an angle of approximately 45° to said directional axis.

32. A fire construction according to claim 30, in which the other step sections are adjacent to the said at least one step section.

33. A fire construction according to claim 1, in which the supply conduit has a generally circular cross section around a directional axis thereof as it extends through the firebox.

34. A fire construction according to claim 1, in which the supply conduit has an elongate cross section across a direction of extension thereof through the firebox.

35. A fire construction according to claim 34, in which the supply conduit defines an elongate opening that opens into the combustion chamber.

36. A fire construction according to claim 1, in which the supply conduit connects the combustion chamber to an air supply externally of the firebox.

37. A fire construction according to claim 36, in which the air supply is ambient air.

38. A fire construction according to claim 1, wherein convections in the combustion chamber draw air through the first air supply means and the supply conduit.

* * * * *